US009745647B2

(12) United States Patent
Barnett et al.

(10) Patent No.: US 9,745,647 B2
(45) Date of Patent: Aug. 29, 2017

(54) WROUGHT MAGNESIUM ALLOY

(71) Applicants: Matthew Robert Barnett, Inverleigh (AU); Christopher Huw John Davies, Windsor (AU); Aiden Graeme Beer, Geelong (AU)

(72) Inventors: Matthew Robert Barnett, Inverleigh (AU); Christopher Huw John Davies, Windsor (AU); Aiden Graeme Beer, Geelong (AU)

(73) Assignee: MAGONTEC LIMITED, Potts Point (AU)

( * ) Notice: Subject to any disclaimer, the term of this patent is extended or adjusted under 35 U.S.C. 154(b) by 68 days.

(21) Appl. No.: 14/613,234

(22) Filed: Feb. 3, 2015

(65) Prior Publication Data

US 2015/0218680 A1 Aug. 6, 2015

Related U.S. Application Data

(63) Continuation of application No. 12/674,120, filed as application No. PCT/AU2008/001285 on Aug. 29, 2008, now abandoned.

(30) Foreign Application Priority Data

Aug. 31, 2007 (AU) ..... 20077904722

(51) Int. Cl.

| | |
|---|---|
| ***C22C 23/06*** | (2006.01) |
| ***C22C 23/00*** | (2006.01) |
| ***C22C 23/02*** | (2006.01) |
| ***C22C 23/04*** | (2006.01) |
| ***C22F 1/06*** | (2006.01) |
| ***B21C 23/00*** | (2006.01) |

(52) U.S. Cl.
CPC ..... *C22C 23/00* (2013.01); *B21C 23/005* (2013.01); *C22C 23/02* (2013.01); *C22C 23/04* (2013.01); *C22F 1/06* (2013.01)

(58) Field of Classification Search
CPC ..... C22C 23/00; B21C 23/00; C22F 1/06
See application file for complete search history.

(56) References Cited

U.S. PATENT DOCUMENTS 2,270,190 A * 1/1942 McDonald ..... C22C 23/00 420/505

FOREIGN PATENT DOCUMENTS

GB 858200 A * 1/1961 ..... C22F 1/06

OTHER PUBLICATIONS

"Heat Treating of Magnesium Alloys," American Society for Metals, Metals Handbook: v. 4 'Heat Treatment' ISBN 0-87170-010-7, pp. 744-745; 9th Ed: 1981.*

Raja K. Mishra et al.,Influence of cerium on the texture and ductility of magnesium extrusions, Scripta Materialia 59 (2008) 562-565.*

* cited by examiner

*Primary Examiner* — Jonathan Johnson
*Assistant Examiner* — Christopher Kessler
(74) *Attorney, Agent, or Firm* — Rodman & Rodman LLP

(57) ABSTRACT

An extrusion of a magnesium-based alloy consisting of, by weight:

0.5 to 1.5% manganese, 0.15 to 0.4% rare earth including lanthanum wherein the lanthanum content of the alloy is 0.15% to less than 0.3%, and up to 0.1% strontium, the balance being magnesium except for incidental impurities which includes zinc.

18 Claims, 4 Drawing Sheets

Alloy A

Alloy A

Alloy B

Alloy A

Alloy B

WROUGHT MAGNESIUM ALLOY

This application is a continuation of application Ser. No. 12/674,120 filed Mar. 23, 2011 and now abandoned.

FIELD OF THE INVENTION

The present invention relates to a magnesium alloy, in particular to a wrought magnesium alloy. A wrought alloy is an alloy which has the potential to be worked into a shape or condition after casting. The present invention also relates to a method of manufacturing a wrought magnesium alloy article.

SUMMARY OF THE INVENTION

According to a first aspect of the present invention, there is provided a magnesium-based alloy consisting of, by weight:

0.5 to 1.5% manganese, 0.05 to 0.5% lanthanum, 0 to 1.5% zinc, and 0 to 0.1% strontium the balance being magnesium except for incidental impurities.

According to a second aspect of the present invention, there is provided a magnesium-based alloy consisting of, by weight:

0.5 to 1.5% manganese, 0.05 to 0.5% rare earth of which more than 70% is lanthanum, 0 to 1.5% zinc and 0 to 0.1% strontium, the balance being magnesium except for incidental impurities.

Preferably more than 80% of the rare earth content is lanthanum, more preferably more than 90%. The rare earth content may be 100% lanthanum, less any incidental impurities.

Preferably the rare earth content is at least 0.1, more preferably at least 0.2%, preferably no more than 0.4%, preferably no more than 0.3%. The rare earth content may be greater than 0.25%.

The rare earth content may be added as a "misch metal" which is understood to comprise an amount of at least two of the rare earth elements.

Throughout the specification, "rare earth" and "rare earth elements" is understood to mean any of the elements with atomic numbers 57 (lanthanum) through 71 (lutetium), In addition to lanthanum, the rare earth content may also comprise cerium. The cerium content is less than the lanthanum content.

The rare earth content may also comprise praseodymium and/or neodymium, typically only in small amounts (<5% of the total rare earth content).

Preferably, the lanthanum content of the alloy is 0.05 to 0.5%, more preferably at least 0.09%, more preferably at least 0.1%, more preferably at least 0.15%, preferably no more than 0.4%, more preferably no more than 0.3%. The lanthanum content of the alloy may be greater than 0.25%.

Preferably, the manganese content is greater than 0.6%, more preferably less than 1.3%, more preferably 0.7 to 1.2%, and most preferably about 1%.

Zinc is an optional component of the alloy, which may be added to strengthen the alloy. When present, the zinc content is preferably less than 1.3%, more preferably 0.2 to 1.3%, more preferably 0.2 to 1.1%, more preferably 0.4 to 1.1%, and most preferably 0.5 to 1.0%.

Incidental impurities may comprise aluminium and silicon. The weight of aluminium in the alloy is preferably no greater than 0.03%. The weight of silicon in the alloy is preferably no greater than 0.03%.

Strontium is an optional component of the alloy, which may be added to strengthen the alloy. When present, the strontium content is preferably greater than 0.01%, preferably no more than 0.1%, more preferably about 0.02%.

According to a third aspect of the present invention, there is provided a wrought magnesium alloy article comprising an amount of an alloy according to the first or second aspect of the present invention which has been worked into a shape or condition.

According to a fourth aspect of the present invention, there is provided a method of manufacturing a wrought magnesium alloy article, the method comprising the steps of:

(a) heating a casting of a magnesium-based alloy at a first temperature for a first period of time, (b) cooling the casting, and (c) working the casting into a shape or condition.

Step (c) may comprise extruding, forging or any other type of working of the casting.

The method may also comprise the step of:

(d) ageing the casting at a second temperature for a second period of time, after step (b) and prior to step (c).

Preferably, the first temperature is 450° C.-650° C., more preferably 540° C.-580° C.

Preferably, the first period of time is 0.5-6 hours, more preferably 1-5 hours.

Preferably, the second temperature is 300° C.-400° C., more preferably 325° C.-375° C.

Preferably, the second period of time is 2-24 hours, more preferably 5-16 hours.

According to a fifth aspect of the present invention, there is provided a method of manufacturing a wrought magnesium alloy article, the method comprising the steps of:

(a) heating a worked casting of a magnesium-based alloy at a first temperature for a first period of time;

(b) cooling the worked casting; and (c) re-working the casting into a shape or condition.

Step (c) may comprise extruding, forging or any other type of working of the casting.

The method may also comprise the step of:

(d) ageing the worked casting at a second temperature for a second period of time, after step (b) and prior to step (c).

Preferably the first temperature is 450° C.-650° C., more preferably 540° C.-580° C.

Preferably, the first period of time is 6-20 hours, more preferably 8-14 hours, most preferably 12 hours.

Preferably, the second temperature is 300° C.-400° C., more preferably 325° C.-375° C.

Preferably, the second period of time is 2-24 hours, preferably 5-16 hours.

The following embodiments may be incorporated into the fourth or fifth aspects of the present invention:

Preferably, the magnesium-based alloy may be any magnesium-based alloy which is amenable to precipitation.

In an embodiment, the magnesium-based alloy may be the alloy according to the first or second aspect of the present invention.

In another embodiment, the magnesium-based alloy consists of, by weight:

0.5 to 1.5% manganese, 0.05 to 0.5% rare earths, 0 to 1.5% zinc, and 0 to 0.1% strontium the balance being magnesium except for incidental impurities.

Preferably, the rare earth content is 0.1 to 0.5%, more preferably 0.2 to 0.5%, more preferably, 0.3 to 0.5%, most preferably about 0.4%.

In an embodiment, the rare earth content is provided by a "misch metal".

Preferably, the rare earth content comprises at least lanthanum.

Preferably, the rare earth content also comprises cerium.

DETAILED DESCRIPTION OF PREFERRED EMBODIMENTS

A number of alloys according to embodiments of the present invention were cast as 2 kg billets by gravity casting. It is noted however, that other suitable casting methods such as direct chill casting may be employed. Table 1 below sets out the contents of the magnesium alloys prepared.

TABLE 1

| Alloys Prepared | | | |
|---|---|---|---|
| Alloy | Manganese (wt % ) | Lanthanum (wt % ) | Zinc (wt % ) |
| A | 1.0 | 0.2 | — |
| B | 1.0 | 0.2 | 0.5 |
| C | 1.0 | 0.1 | — |
| D | 1.0 | 0.3 | — |
| E | 1.0 | 0.1 | 0.5 |
| F | 1.0 | 0.3 | 0.5 |
| G | 1.0 | 0.2 | 1.0 |

In each of alloys A to G, magnesium constituted the balance except for incidental impurities. Upon chemical analysis, impurities were found to comprise approximately 0.01 wt % aluminium and less than 0.002 wt % iron in all of the alloys.

Figure 1A:
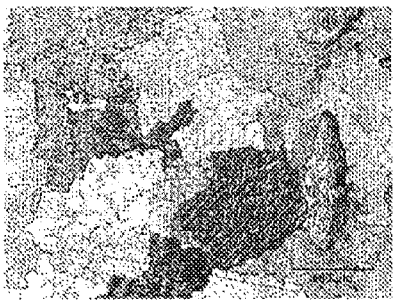
FIGS. 1A and 1B are micrographs showing the microstructure of alloys A and B as cast.
Figure 1B:
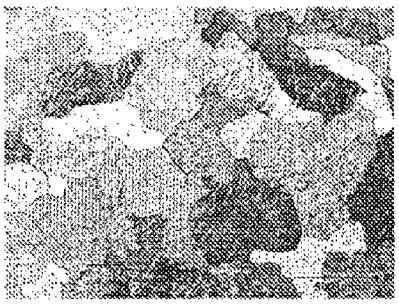

FIGS. 1A and 1B show the microstructure of alloys A and B as cast. Alloy B, which contains 0.5 wt % zinc has smaller grains than alloy A, which contains no zinc but the same amounts of manganese and lanthanum.

Samples of alloys A and B were subsequently extruded after being subjected to a solutionising pre-treatment in which the samples were heated at approximately 580° C. for approximately 1 hour. The samples were extruded at different billet temperatures and ram speeds (ie. the speed at which the alloy is extruded in mm/sec) to establish the extrusion limits of these alloys. Extrusion limits of an alloy are understood to be the limits of the speed and temperature at which the alloy can be satisfactorily extruded. At high billet temperatures, cracking may occur in the extruded alloy if the ram speed is too high. Furthermore, at low temperatures, the maximum ram speed at which the alloy may be extruded is limited by the load capacity of the extrusion press, such that at a certain low temperature, the alloy is not extrudable at all.

Figure 2A:
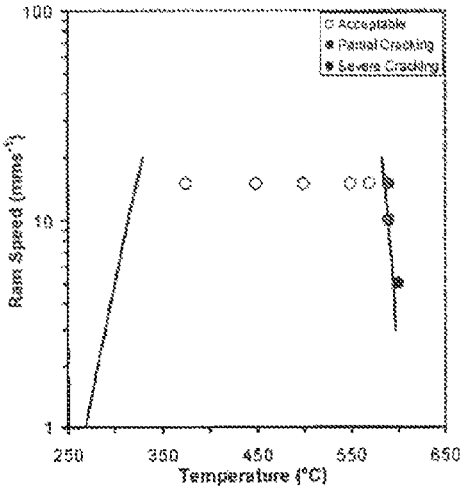
FIGS. 2A and 2B are extrusion limit diagrams of alloys A and B.
Figure 2B:
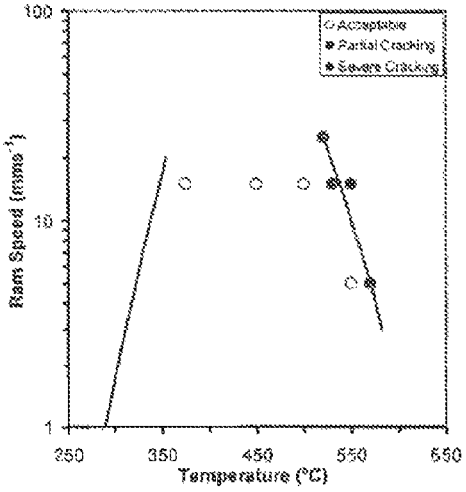
Figure 3:
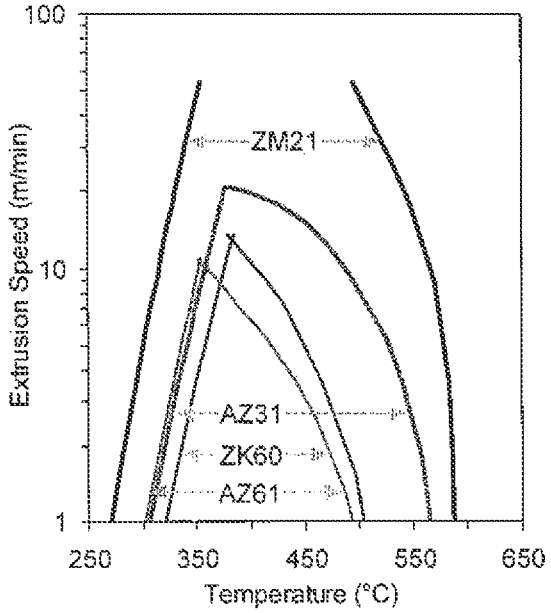
FIG. 3 is an extrusion limit diagram for alloys AZ31, ZK60, AZ61 and ZM21

FIGS. 2A and 2B are extrusion limit diagrams of alloys A and B. It is noted that alloy A has wider extrusion limits than alloy B. It would therefore appear that adding the 0.5% zinc (alloy B) narrows the extrusion limits of the alloy. For all alloys A and B, however, FIGS. 2A and 2B demonstrate that they may be satisfactorily extruded at high speeds and high temperatures. FIG. 3, for example, shows the extrusion limit windows for a number of industry common alloys, AZ31, ZK60, AZ61 and ZM21 which have the following nominal compositions:

TABLE 2

| | Nominal Composition | | | | |
|---|---|---|---|---|---|
| Alloy | Al (wt %) | Zn (wt %) | Mn (wt %) | Zr (wt %) | Bal. |
| AZ31 | 3.0 | 1.0 | 0.2 | — | Mg |
| AZ61 | 6.5 | 1.0 | 0.15 | — | Mg |
| ZM21 | — | 2.0 | 0.5 | — | Mg |
| ZK60 | — | 5.5 | — | 0.45 min | Mg |

It can be seen from FIG. 3 that alloys A and B compares favourably with the industry alloys, in particular AZ31, which is the most commonly used.

Figure 4:
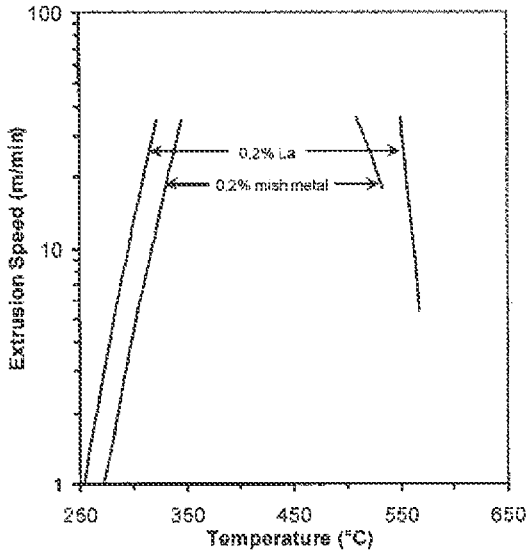
FIG. 4 is an extrusion limit diagram which compares alloy H to alloy A.

The effect of the lanthanum addition on the extrudability on the alloy was also considered by preparation and extruding alloy H which contained (by weight) 1% manganese, 0.2% rare earth as a misch metal (consisting of 0.13% cerium and 0.07% lanthanum), with the balance magnesium except for incidental impurities. FIG. 4 provides an extrusion limit diagram which compares alloy H to alloy A. FIG. 4 demonstrates that alloy A has improved extrudability over alloy H. Without wishing to be bound by theory it is believed that the improved extrudability of alloy A (over alloy H) is due to the lanthanum addition not lowering the solidus temperature nor increasing the hot working flow stress as much as the misch metal addition consisting predominantly of cerium.

Alloy A, at least, was found to have a proof stress in tension of approximately 160-200 MPa and a proof stress in compression of 110 MPa, which may be improved by ageing of the alloy. It is noted that the proof stress in tension is dependent on the solutionising temperature and the grain size of the alloy.

The grain size of alloys A and B was also measured following extrusion (the alloys having been subjected to a solutionising treatment prior to extrusion) at a ram speed of 15 mm/sec for different billet temperatures. It was found that a lower grain size was achieved at lower extruding temperatures.

Sample Castings of alloys A to F were also extruded at a ram speed of 15 mm/sec and 375° C. following a pretreatment of the cast billets. Different pre-treatments were carried out and the grain size of the extruded alloys measured. Each pre-treatment first involved a solutionising step in which the casting was heated at a temperature of 500 to 580° C. Some pre-treatments further involved an ageing step in which, after quenching the heated casting, further heating of the casting at a lower temperature (approximately 350° C.). Table 3 below provides details of the pre-treatments carried out, and the resulting grain size of the extruded alloys.

TABLE 3

Grain Size of Extruded Alloys having undergone Pre-treatment

| Alloy | Solutionising Temperature | Solutionising Time | Ageing Temperature | Ageing Time | Grain Size (μm) |
|---|---|---|---|---|---|
| A | 580° C. | 1 hr | 350° C. | 8 hrs | 7.7 |
| A | 550° C. | 1 hr | — | — | 7.3 |
| A | 500° C. | 1 hr | — | — | 8.5 |
| A | 580° C. | 1 hr | — | — | 11.4 |
| A | 580° C. | 4 hrs | — | — | 5.6 |
| B | 580° C. | 1 hr | 350° C. | 8 hrs | 5.8 |
| B | 550° C. | 1 hr | — | — | 10.6 |
| B | 500° C. | 1 hr | — | — | 11.7 |
| B | 580° C. | 1 hr | — | — | 14.1 |
| B | 580° C. | 4 hrs | — | — | 7.6 |
| C | 580° C. | 4 hrs | — | — | 9.7 |
| C | 580° C. | 4 hrs | 350° C. | 8 hrs | 8.6 |
| D | 580° C. | 4 hrs | — | — | 8.3 |
| D | 580° C. | 4 hrs | 350° C. | 8 hrs | 8.3 |
| E | 580° C. | 4 hrs | — | — | 7.5 |
| E | 580° C. | 4 hrs | 350° C. | 8 hrs | 8.8 |
| F | 580° C. | 4 hrs | — | — | 7.4 |
| F | 580° C. | 4 hrs | 350° C. | 8 hrs | 7.4 |

Referring to Table 3, it is notable for alloys A and B that a longer homogenisation time (ie. time spent at the solutionising temperature) appears to result in finer grain sizes being obtained in the extruded alloy. It is also noted that the addition of zinc (alloy B) appears to render the alloy sensitive to aging prior to extrusion, such that finer grain sizes may be obtained by ageing magnesium-manganese-lanthanum alloys also containing zinc.

The deformation and annealing behaviour of alloy A was further assessed. Samples were machined from extrudates of alloy A which had been subjected to a pre-treatment prior to extrusion involving solutionising and ageing or just solutionising. Compression testing was conducted at a temperature of 350° C. and at a strain rate of 0.1 $s^{-1}$. The samples were deformed to an equivalent strain of 1.5, after which the samples were held at the deformation temperature for times ranging from 1 s to 1000 s prior to being water quenched.

Figure 5:
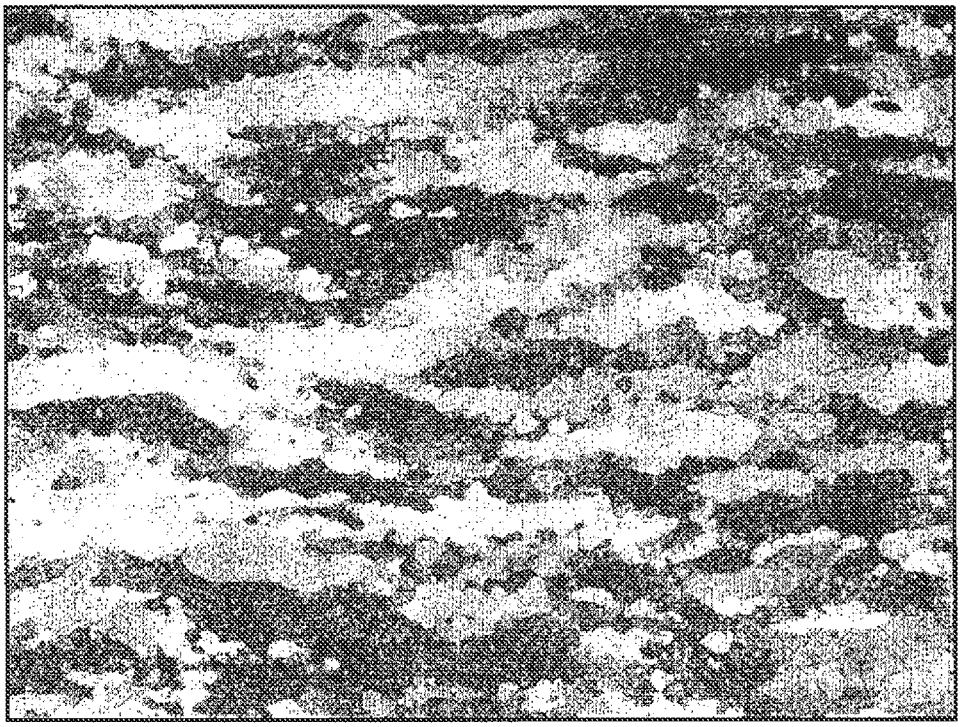
FIG. 5 is a micrograph of alloy A after hot deformation and annealing.
Figure 6:
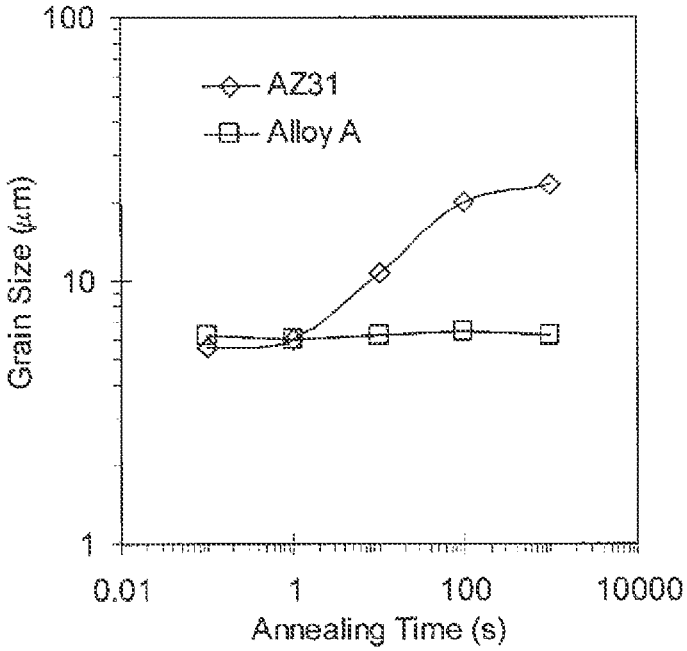
FIG. 6 is a graph showing the stability of the microstructure of alloy A against AZ31 after compression at 350° C. at a strain of 1.5, followed by annealing at the same temperature.

No substantial change in the grain size was observed in the alloy following the deformation and annealing conditions employed. Average grain sizes of approximately 6-7 μm were found in all samples, regardless of the pre-treatment undergone by the alloy prior to extrusion. By way of comparison, FIG. 5 shows the stability of the microstructure of alloy A against AZ31 after compression at 350° C. at a strain of 1.5, followed by annealing at the same temperature. As can be seen in FIG. 5, after a 1000 seconds of annealing, the grain size of AZ31 increases from 6 microns to 25 microns, while the grain size of alloy A remains generally unchanged during this time. Without wishing to be bound by theory, it is understood that the ability of alloy A to maintain a fine grain size is due to the lanthanum addition as the lanthanum restricts the mobility of grain boundaries during recrystallisation. The stability of the grain size of the alloy means that when it is worked (ie. extruded or forged) at elevated temperatures, a small grain size is maintained during slow cooling and/or subsequent annealing. By comparison, when alloy A and AZ31 were both extruded under the same conditions (billet temperature of 370° C., extrusion speed of 6 m/min), the average grain size developed in AZ31 was three times greater than that of alloy A (23 microns compared to 7 microns). This can also be seen in the microstructures shown in the comparative micrographs of FIG. 6. In general, however, it is shown that advantageously, lanthanum reduces the grain size of the alloy.

Figure 7:
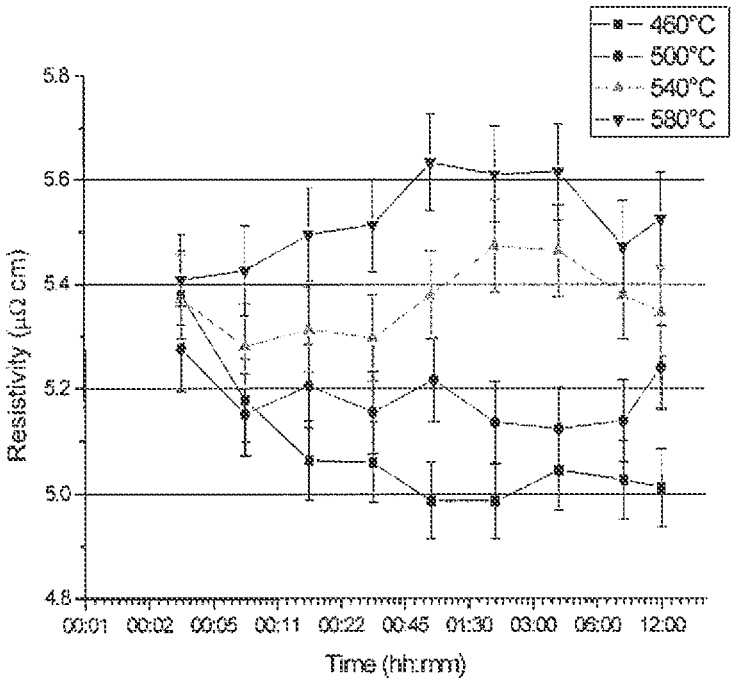
FIG. 7 is a graph showing the change in resistivity for the increase in heat treatment times at various temperatures for alloy A.

The effect of pretreatment of alloy A was further studied by measuring the electrical resistivity of the alloy during heat treatments of increasing time and at temperatures ranging from 460° C. to 580° C. Generally, it is understood that resistivity will decrease during precipitation (at lower temperatures) and will increase as precipitates are dissolved (at higher temperatures). FIG. 7 shows the change in resistivity for the increase in heat treatment times at the various temperatures. It can be seen from FIG. 7 that the resistivity remains fairly constant at intermediate temperatures, but increases at 580° C. possibly due to the dissolving of precipitates and decreases at 460° C. possibly due to precipitation and/or to the coarsening of precipitates already present in the alloy from casting.

To determine whether these results for the resistivity indicated an important microstructural change in the alloy, billets of alloy A were heat treated at 580° C. and 460° C. for times of 1 and 4 hours, and then extruded at 375° C. and 15 mm/s. Table 4 below sets out the resultant grain sizes and tensile elongations (both uniform and total) in comparison to an as-cast billet which was extruded under the same conditions (i.e. did not undergo heat treatment).

TABLE 4

| Alloy | Solutionising Temperature | Solutionising Time | Grain Size (μm) | Uniform Elongation (%) | Total Elongation (%) |
|---|---|---|---|---|---|
| A | — | — | 10.6 | 8.3 | 13.2 |
| A | 460° C. | 1 hr | 13.9 | 9.0 | 13.6 |
| A | 460° C. | 4 hr | 16.5 | 8.9 | 12.2 |
| A | 580° C. | 1 hr | 9.2 | 11.5 | 18.6 |
| A | 580° C. | 4 hr | 11.1 | 10 | 15.9 |

As indicated in Table 4, the solution treatment at 580° C. did yield a slightly smaller grain size relative to the untreated billet (when the heating time was 1 hour). However, solution treatment at 460° C. resulted in larger extruding grain sizes. Without wishing to be bound by theory, it is believed that this is due to particle precipitation occurring at 460° C. leaving less lanthanum in solid solution to inhibit grain coarsening. It is also noted that solution treatment at 580° C. enhanced the tensile ductility of the untreated alloy whereas treatment at 460° C. had little or no effect on the ductility.

Figure 8:
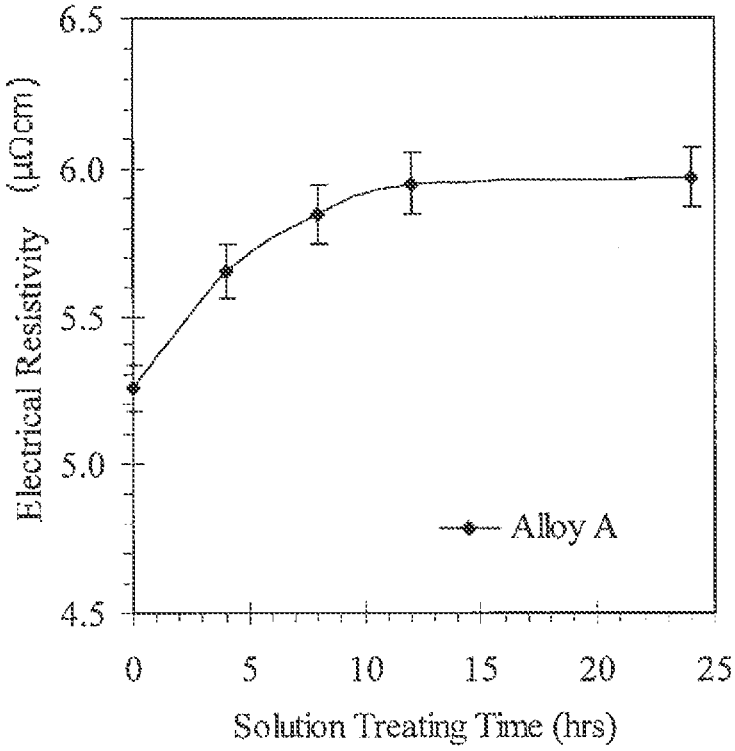
FIG. 8 is a graph showing the change of electrical resistivity for increasing solution treatment times for alloy A.

The effect of solution treatment on extruded alloys (as opposed to as cast alloys) followed by a second extrusion step was also conducted. Electrical resistivity measurements were taken on wrought billets of alloy A after they had been subjected to solution treatment at 580° C. for increasing times. Billets were machined from industrial scale extruded rods of alloy A. FIG. 8 shows the change of electrical resistivity for increasing solution treatment times. As indicated by FIG. 8, the electrical resistivity increased for solution treating times of up to 12 hours, after which it was substantially constant. It therefore appears that a longer solution treatment time is required for alloy which has already been extruded compared to as cast alloys. The solution treated billets were subsequently extruded at 375° C. at 15 mm/s. Table 5 below sets out the grain sizes for the billets.

TABLE 5

| Alloy | Solutionising Temperature | Solutionising Time | Grain Size (μm) |
|---|---|---|---|
| A | 580° C. | 4 hr | 11.9 |
| A | 580° C. | 8 hr | 8.1 |
| A | 580° C. | 12 hr | 7.6 |
| A | 580° C. | 24 hr | 7.2 |

It can be seen from Table 5 that with increasing solution treatment time, the extruded grain size is reduced.

Alloys were also prepared to determine the effect of the addition of strontium to the alloy. Alloys were prepared containing (by weight) 1.0% manganese, 0.2% lanthanum and either 0.02% or 0.04% strontium with the balance magnesium except for incidental impurities. These alloys were extruded at 375° C. and 15 mm/s and the grain size and mechanical properties of the extruded alloys were measured. Table 6 below sets out these properties as compared to Alloy A (having 1.0% manganese, 0.2% lanthanum, 0% strontium, balance magnesium).

TABLE 6

| Strontium (wt %) | Grain Size (μm) | Yield Strength (MPa) | Tensile Strength (MPa) |
|---|---|---|---|
| 0 | 5.6 | 161 | 251 |
| 0.02 | 5.8 | 203 | 259 |
| 0.04 | 8.6 | 165 | 245 |

As shown in Table 6, a strengthening effect was observed for the 0.02% strontium addition but not for the 0.04% strontium addition.

Pre-treatment of other magnesium-based alloys prior to extrusion was also trailed. In one trial, samples of a magnesium-manganese-rare earth alloy (Alloy I) were pretreated using various solutionising and ageing processes. Alloy I contained 1 wt % manganese, 0.27 wt % cerium and 0.13 wt % lanthanum, with the balance magnesium except for incidental impurities. The cerium and lanthanum were added to Alloy I as a "misch-metal". It was found that both solutionising and solutionising and ageing this alloy prior to extruding resulted in an extruded alloy which had finer grain sizes. Table 6 shows the results of this trial below.

TABLE 7

Grain Size of Extruded Alloy having undergone Pre-treatment

| Alloy | Solutionising Temperature | Solutionising Time | Ageing Temperature | Ageing Time | Grain Size (μm) |
|---|---|---|---|---|---|
| I | 580° C. | 1 hr | 350° C. | 8 hrs | 6.6 |
| I | 550° C. | 1 hr | — | — | 9.0 |
| I | 500° C. | 1 hr | — | — | 10.1 |
| I | 580° C. | 1 hr | — | — | 10.0 |
| I | 580° C. | 4 hrs | — | — | 7.5 |

Trials were also conducted to study the effects of aluminium and silicon on wrought magnesium alloys. Aluminium and silicon are incidental impurities in any such alloys. Magnesium based alloys consisting of 1.0% manganese and 0.2% lanthanum were prepared with differing amounts of aluminium and silicon as set out in Table 8 below, and extruded at 375° C. and 15 mm/s.

TABLE 8

| Aluminium (wt %) | Silicon (wt %) | Grain Size (μm) | Uniform Elongation (%) | Total Elongation (%) |
|---|---|---|---|---|
| 0.01 | 0.03 | 5.6 | 13.7 | 29.8 |
| 0.01 | 0.08 | 10.8 | 12.2 | 21.0 |
| 0.03 | — | 7.9 | 11.3 | 16.6 |
| 0.045 | — | 7.3 | 12.4 | 21.2 |
| 0.06 | — | 7.4 | 11.7 | 15.5 |
| 0.5 | — | 47.6 | 4.7 | 6.4 |

As can be seen from Table 8, aluminium and silicon were found to have a deleterious effect on the grain size and ductility of the alloy. Without wishing to be bound by theory, it is understood that the deleterious effect caused by aluminium and silicon is due to both aluminium and silicon readily forming Mg—Al—La and Mn—Si—La particles respectively, which are at least partially responsible for the increase in grain size because some of the lanthanum content is used up in these particles.

It has been found that an additional benefit of a strontium addition to the alloy is that is suppresses the detrimental effect of aluminium. By way of example, an alloy containing (by weight) 1.0% manganese, 0.2% lanthanum, 0.5% aluminium, 0.04% strontium, with the balance magnesium except for incidental impurities was prepared and extruded at 375° C. and 15 mm/s. This alloy was found to have a grain size of 7.4 μm, a uniform elongation of 12.1% and a total elongation of 19.6%. This compares favourably to the alloy containing 0.5% aluminium and 0% strontium, the properties for which are set out in Table 8 above.

In the claims which follow and in the preceding description of the invention, except where the context requires otherwise due to express language or necessary implication, the word "comprise" or variations such as "comprises" or "comprising" is used in an inclusive sense, ie. to specify the presence of the stated features but not to preclude the presence or addition of further features in various embodiments of the invention.

What is claimed is:

1. A solution pretreated extrusion of a magnesium-based alloy consisting of, by weight:

0.5 to 1.5% manganese, 0.15% to 0.4% rare earth including lanthanum and cerium wherein the lanthanum content of the alloy is 0.15% to less than 0.3% and the cerium content is less than the lanthanum content, and up to 0.1% strontium, the balance being magnesium except for incidental impurities which includes zinc, wherein the extrusion has a grain size from 5.6 to 11.4 microns.

2. An extrusion as claimed in claim 1, wherein at least 70% of the rare earth content is lanthanum.

3. An extrusion as claimed in claim 1, wherein the alloy consists of 0.2-less than 0.3% rare earth.

4. An extrusion as claimed in claim 1, wherein the alloy consists of 0.25%-0.4% rare earth.

5. An extrusion as claimed in claim 4, wherein the lanthanum content of the alloy is 0.2-less than 0.3%.

6. An extrusion as claimed in claim 4, wherein the lanthanum content of the alloy is 0.25%-less than 0.3%.

7. An extrusion as claimed in claim 1, wherein the manganese content is greater than 0.6% and less than 1.3%.

8. An extrusion as claimed in claim 1, wherein the incidental impurities comprise aluminium at no greater than 0.03% of the alloy.

9. An extrusion as claimed in claim 1, wherein the incidental impurities comprise silicon at no greater than 0.03% of the alloy.

10. An extrusion as claimed in claim 1, wherein the extrusion has a proof stress in tension without aging of 160-200 MPa.

11. An extrusion as claimed in claim 1, wherein the extrusion has a proof stress in compression without aging of approximately 110 MPa.

12. An extrusion as claimed in claim 1, wherein the average grain size of the extruded alloy is 6-7 μm.

13. An extrusion as claimed in claim 1, wherein the extrusion is formed by:

(a) heating a casting of the magnesium-based alloy at a first temperature for a first period of time, (b) cooling the casting, and (c) extruding the casting to produce the extrusion.

14. An extrusion as claimed in claim 13, wherein the extrusion is formed by:

(d) ageing the casting at a second temperature for a second period of time, after step (b) and prior to step (c).

15. An extrusion as claimed in claim 14, wherein the second temperature is 300° C.-400° C.

16. An extrusion as claimed in claim 14, wherein the second period of time is 2-24 hours.

17. An extrusion as claimed in claim 13, wherein the first temperature is 450° C. 650° C.

18. An extrusion as claimed in claim 13, wherein the first period of time is 0.5-6 hours.

* * * * *